US010577777B2

(12) United States Patent
Cho et al.

(10) Patent No.: US 10,577,777 B2
(45) Date of Patent: Mar. 3, 2020

(54) CONTROL SYSTEM FOR CONSTRUCTION MACHINERY

(71) Applicant: Doosan Infracore Co., Ltd., Incheon (KR)

(72) Inventors: Yong-Lak Cho, Incheon (KR); Hyun-Sik Lim, Incheon (KR); Soo-Kwang Lee, Seoul (KR); Young-Shik Cho, Gyeonggi-do (KR)

(73) Assignee: DOOSAN INFRACORE CO., LTD., Incheon (KR)

( * ) Notice: Subject to any disclaimer, the term of this patent is extended or adjusted under 35 U.S.C. 154(b) by 227 days.

(21) Appl. No.: 15/542,987

(22) PCT Filed: Jan. 12, 2016

(86) PCT No.: PCT/KR2016/000297
§ 371 (c)(1),
(2) Date: Oct. 31, 2017

(87) PCT Pub. No.: WO2016/114556
PCT Pub. Date: Jul. 21, 2016

(65) Prior Publication Data

US 2018/0044891 A1 Feb. 15, 2018

(30) Foreign Application Priority Data

Jan. 14, 2015 (KR) ..... 10-2015-0006614

(51) Int. Cl.
*E02F 9/22* (2006.01)
*E02F 9/26* (2006.01)
(Continued)

(52) U.S. Cl.
CPC ..... *E02F 9/2228* (2013.01); *E02F 9/2267* (2013.01); *E02F 9/2271* (2013.01);
(Continued)

(58) Field of Classification Search
CPC ..... E02F 9/2228; E02F 9/2235; E02F 9/2285; E02F 9/2292; E02F 9/2025; E02F 9/2271;
(Continued)

(56) References Cited

U.S. PATENT DOCUMENTS 5,056,312 A * 10/1991 Hirata ..... E02F 9/2228 60/426
5,267,440 A * 12/1993 Nakamura ..... E02F 9/2232 60/426
(Continued)

FOREIGN PATENT DOCUMENTS

EP 2131045 12/2009
JP 07019207 1/1995
(Continued)

OTHER PUBLICATIONS

Extended European Search Report issued in related European Patent Application No. 16737520.3 dated Jul. 31, 2018.
(Continued)

*Primary Examiner* — Nathaniel E Wiehe
*Assistant Examiner* — Richard C Drake
(74) *Attorney, Agent, or Firm* — K&L Gates LLP

(57) ABSTRACT

A control system for construction machinery includes a main control valve installed in a hydraulic line between a hydraulic pump and actuators, and including a first group of electro proportional pressure reducing valves outputting a secondary pressure in proportion to an external pressure command signal to a first spool for controlling a first group of actuators of the actuators, and a second group of electro proportional pressure reducing valves outputting a secondary pressure in proportion to an external pressure command signal to a second spool for controlling a second group of actuators of the actuators, a first pressure sensor configured to detect the secondary pressure outputted from the first group of electro
(Continued)

proportional pressure reducing valves and a second pressure sensor configured to detect the secondary pressure outputted from the second group of electro proportional pressure reducing valves, and a controller configured to output pressure command signals to the electro proportional pressure reducing valves corresponding to a manipulation signal of the construction machinery, and configured to compare the secondary pressures detected by the first and second pressure sensors and the pressure command signals to determine to determine whether or not the electro proportional pressure reducing valves fail.

5 Claims, 4 Drawing Sheets

(51) Int. Cl.
*F15B 13/02* (2006.01)
*F15B 13/04* (2006.01)
*F15B 21/08* (2006.01)

(52) U.S. Cl.
CPC ..... *E02F 9/2282* (2013.01); *E02F 9/2285* (2013.01); *E02F 9/268* (2013.01); *F15B 13/025* (2013.01); *F15B 13/0416* (2013.01); *F15B 21/08* (2013.01)

(58) Field of Classification Search
CPC ..... E02F 9/2226; E02F 9/2267; E02F 3/32; E02F 3/425; F15B 21/042; F15B 21/08; B62D 11/04; B62D 11/005
USPC ..... 60/459, 426
See application file for complete search history.

(56) References Cited

U.S. PATENT DOCUMENTS

| | | | | |
|---|---|---|---|---|
| 5,289,679 | A * | 3/1994 | Yasuda | E02F 9/2232 60/422 |
| 6,050,090 | A * | 4/2000 | Tohji | E02F 9/2203 60/421 |
| 6,393,838 | B1 * | 5/2002 | Moriya | E02F 9/2228 60/422 |
| 8,387,376 | B2 * | 3/2013 | Son | F15B 11/17 60/394 |
| 8,479,636 | B2 * | 7/2013 | Rub | E02F 9/2285 60/426 |
| 8,646,473 | B2 * | 2/2014 | Hall | F15B 20/008 137/14 |
| 10,227,090 | B2 * | 3/2019 | Kondo | B62D 11/005 |
| 2010/0011757 | A1 * | 1/2010 | Satake | E02F 3/965 60/459 |

FOREIGN PATENT DOCUMENTS

| | | | |
|---|---|---|---|
| JP | 2004-116727 | | 4/2004 |
| KR | 1990-0702146 | | 1/1990 |
| KR | 10-1990-0702146 | A | 12/1990 |
| KR | 20-1995-0007891 | Y1 | 9/1995 |
| KR | 10-2010-0056110 | A | 5/2010 |
| KR | 10-1186496 | B1 | 9/2012 |
| KR | 10-2014-0003852 | A | 1/2014 |

OTHER PUBLICATIONS

International Search Report (with English translation) issued in international application No. PCT/KR2016/000297, dated Apr. 4, 2016, 6 pages.
Written Opinion issued in international application No. PCT/KR2016/000297, dated Apr. 4, 2016, 6 pages.

* cited by examiner

CONTROL SYSTEM FOR CONSTRUCTION MACHINERY

TECHNICAL FIELD

The present invention relates to a control system for construction machinery, more particularly, to a control system for construction machinery including an electro-hydraulic main control valve using an electro proportional pressure reducing valve.

BACKGROUND ART

Recently, the necessity of electronic control in construction machinery is increasing more and more. Especially, in the electronic control in the construction machinery, an electro-hydraulic main control valve with an electro proportional pressure reducing valve (EPPRV) may be used. Thus, risk of failure in the electro proportional pressure reducing valve may be increased compared with a conventional hydraulic main control valve, and accordingly risk management at the failure may become very important.

When the electro proportional pressure reducing valve fails, a secondary pressure outputted from the electro proportional pressure reducing vale may be generated smaller than an external command signal, may not be generated, or may be generated a maximum pressure value. In the former case, an actuator of a vehicle may not move or move slowly, while in the latter case, the actuator may move fast even though the actuator should not move.

In this case, it may be more dangerous for the actuator to move inadvertently or unintentionally, and occasionally an operator may manipulate a safety lever or push an engine emergency button. However, these actions are at the operator's discretion, and in some case, it may be too late to prevent danger in advance.

Further, when the safety lever is manipulated, because the vehicle does not operate to move, it may be difficult to get out the danger zone for the breakdown repair service. Accordingly, in a conventional system where some or all operations are electrically controlled, because when some of the electro proportional pressure reducing valves fail, the whole vehicle does not operate to move or action, there are difficult problems to detect failure and take safety.

DISCLOSURE OF THE INVENTION

Problems to be Solved

The object of the present invention provides a control system for construction machinery capable of detecting a failure of electro proportional pressure reducing valve of an electro-hydraulic main control valve and preventing danger due to the failure.

Means to Solve the Problems

According to example embodiments, a control system for construction machinery includes a main control valve installed in a hydraulic line between a hydraulic pump and actuators, and including a first group of electro proportional pressure reducing valves outputting a secondary pressure in proportion to an external pressure command signal to a first spool for controlling a first group of actuators of the actuators, and a second group of electro proportional pressure reducing valves outputting a secondary pressure in proportion to an external pressure command signal to a second spool for controlling a second group of actuators of the actuators, a first pressure sensor configured to detect the secondary pressure outputted from the first group of electro proportional pressure reducing valves and a second pressure sensor configured to detect the secondary pressure outputted from the second group of electro proportional pressure reducing valves, and a controller configured to output pressure command signals to the electro proportional pressure reducing valves corresponding to a manipulation signal of the construction machinery, and configured to compare the secondary pressures detected by the first and second pressure sensors and the pressure command signals to determine to determine whether or not the electro proportional pressure reducing valves fail.

In example embodiments, the control system for construction machinery may further include a first control valve installed in a first control line through which a pilot working fluid is supplied to the first group of electro proportional pressure reducing valves and configure to selectively open and close the first control line, and a second control valve installed in a second control line through which a pilot working fluid is supplied to the second group of electro proportional pressure reducing valves and configured to selectively open and close the second control line.

In example embodiments, when it is determined that any one of the first group of electro proportional pressure reducing valves fails, the controller may close the first control valve to block the pilot working fluid from being supplied to the first group of electro proportional pressure reducing valves, and when it is determined that any one of the second group of electro proportional pressure reducing valves fails, the controller may close the second control valve to block the pilot working fluid from being supplied to the second group of electro proportional pressure reducing valves.

In example embodiments, the first and second control valves may include a solenoid valve.

In example embodiments, the first group of actuators may include at least one of a right traveling hydraulic motor, a left traveling hydraulic motor and a swing motor, and the second group of actuators may include at least one of a boom cylinder, an arm cylinder and a bucket cylinder.

In example embodiments, the controller may include a first controller configured to compare the secondary pressures detected by the first pressure sensors and the pressure command signals inputted to the first group of the electro proportional pressure reducing valves to determine whether or not the first group of electro proportional pressure reducing valves fail, and a second controller configured to compare the secondary pressures detected by the second pressure sensors and the pressure command signals inputted to the second group of the electro proportional pressure reducing valves to determine whether or not the second group of electro proportional pressure reducing valves fail.

In example embodiments, when it is determined that any one of the first group of electro proportional pressure reducing valves fails, the first controller may generate a first block signal for blocking the pilot working fluid from being supplied to the first group of electro proportional pressure reducing valves, and when it is determined that any one of the second group of electro proportional pressure reducing valves fails, the second controller may generate a second block signal for blocking the pilot working fluid from being supplied to the second group of electro proportional pressure reducing valves.

In example embodiments, the main control valve may further include a hydraulic control valve having a third spool for controlling a third group of actuators of the actuators, the third spool being controlled by a pilot pressure in proportion to a manipulation amount of a manipulation lever.

Effects of the Invention

According to example embodiments, when any one of electro proportional pressure reducing valves included in a particular group fails, all the electro proportional pressure reducing valves included in the particular group may be controlled to be disabled. Accordingly, the electro proportional pressure reducing valves of the particular group including the broken EPPRV may be disabled, while electro proportional pressure reducing valves included in other groups may be operable independently.

Accordingly, a malfunction related to an electro proportional pressure reducing valve may be detected immediately, an operation of an actuator related to the broken EPPRV may be stopped and other actuators may be still operable, and thus, construction machine may escape from a danger zone and move to a serviceable zone.

However, the effect of the invention may not be limited thereto, and may be expanded without being deviated from the concept and the scope of the present invention.

BEST MODE FOR CARRYING OUT THE INVENTION

Detailed Description of Example Embodiments

Figure 1:
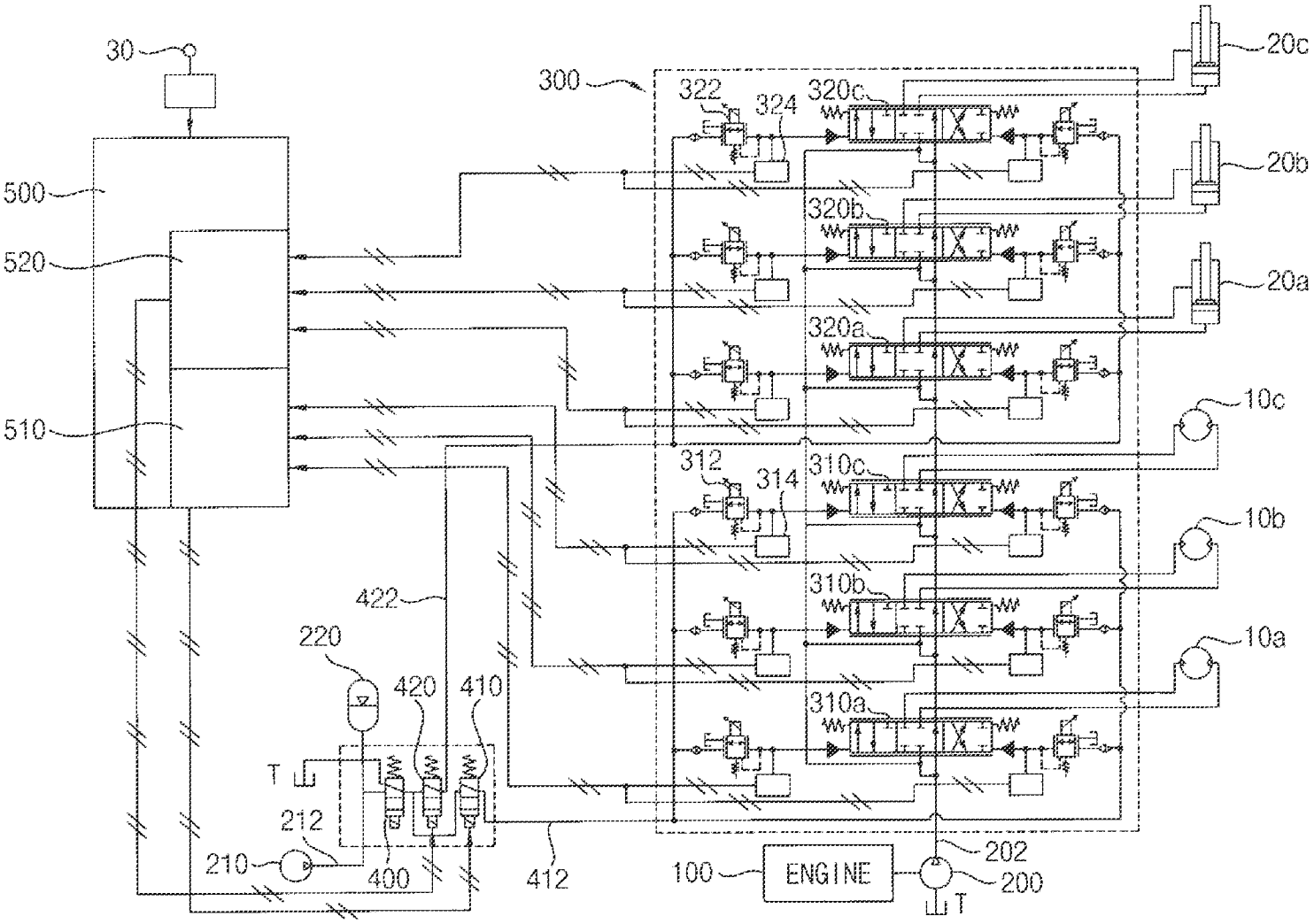
FIG. 1 is a hydraulic circuit diagram illustrating a control system for construction machinery in accordance with example embodiments.

Hereinafter, preferable embodiments of the present invention will be explained with reference to the attached drawings. Various example embodiments will be described more fully hereinafter with reference to the accompanying drawings, in which example embodiments are shown. Example embodiments may, however, be embodied in many different forms and should not be construed as limited to example embodiments set forth herein. Rather, these example embodiments are provided so that this disclosure will be thorough and complete, and will fully convey the scope of example embodiments to those skilled in the art. In the drawings, the sizes and relative sizes of components or elements may be exaggerated for clarity.

It will be understood that when an element or layer is referred to as being "on," "connected to" or "coupled to" another element or layer, it can be directly on, connected or coupled to the other element or layer or intervening elements or layers may be present. In contrast, when an element or layer is referred to as being "directly on," "directly connected to" or "directly coupled to" another element or layer, there are no intervening elements or layers present. Like numerals refer to like elements throughout. As used herein, the term "and/or" includes any and all combinations of one or more of the associated listed items.

It will be understood that, although the terms first, second, third, etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed below could be termed a second element, component, region, layer or section without departing from the teachings of example embodiments.

Spatially relative terms, such as "beneath," "below," "lower," "above," "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular example embodiments only and is not intended to be limiting of example embodiments. As used herein, the singular forms "a," "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Figure 2:
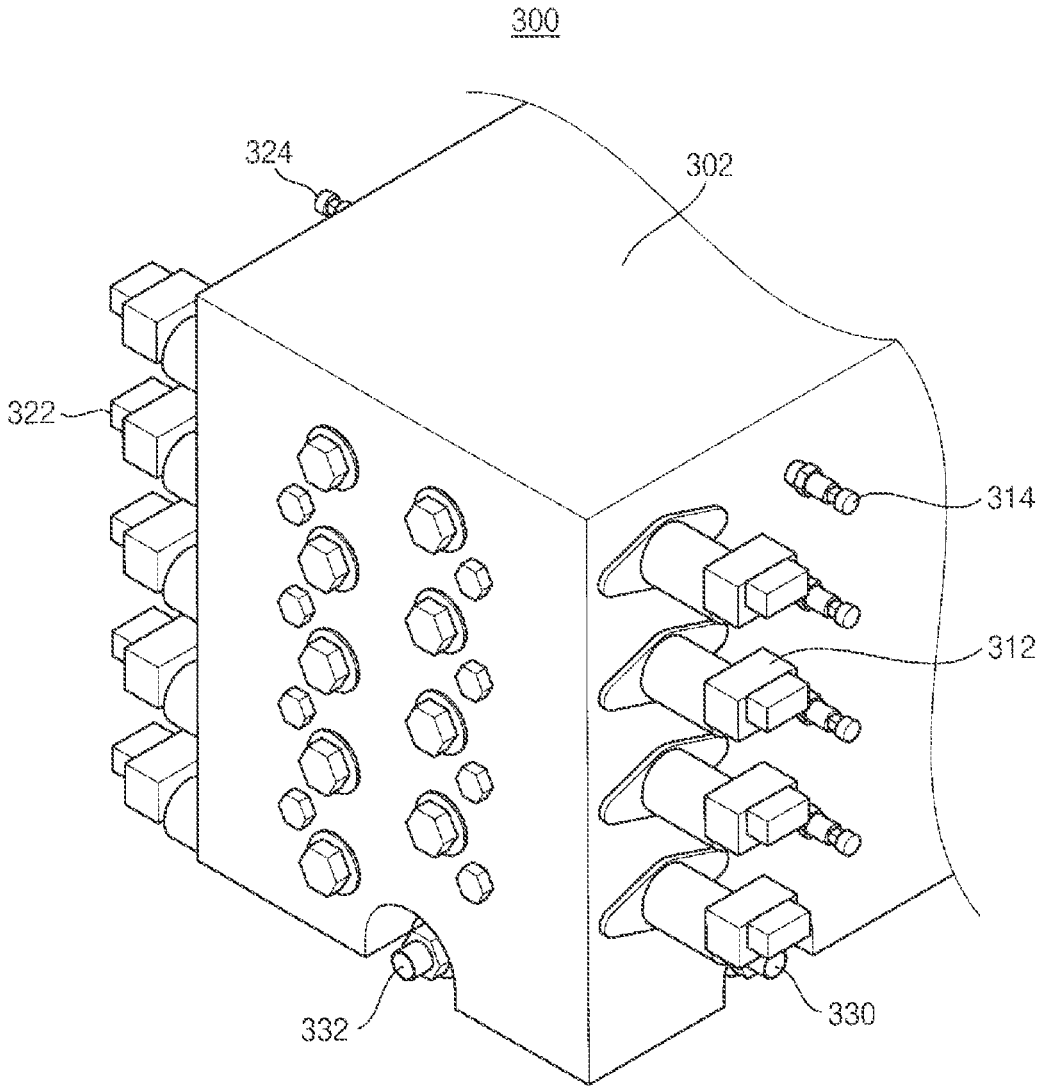
FIG. 2 is a perspective view illustrating a portion of a main control valve in FIG. 1.

FIG. 1 is a hydraulic circuit diagram illustrating a control system for construction machinery in accordance with example embodiments. FIG. 2 is a perspective view illustrating a portion of a main control valve in FIG. 1.

Referring to FIGS. 1 and 2, a control system may include at least one main hydraulic pump 200 connected to an engine 100, a main control valve 300 installed in a hydraulic line between the main hydraulic pump 200 and actuators 10*a*, 10*b*, 10*c*, 20*a*, 20*b*, 20*c* and configured to control operations of the actuators 10*a*, 10*b*, 10*c*, 20*a*, 20*b*, 20*c*, and a controller 500 configured to output a pressure command signal as an electrical control signal to the main control valve 300 corresponding to a manipulation signal of an operator.

In example embodiments, the engine 100 may include a diesel engine as a driving source for construction machinery, i.e., excavator. The main hydraulic pump 200 may be connected to an engine 100 via a power take off (PTO). Although it is not illustrated in the figures, a pilot pump 210 and additional hydraulic pumps may be connected to the engine 100. Accordingly, an output power of the engine 100 may be transmitted to the main hydraulic pump 200 and the pilot pump 210.

The main hydraulic pump 200 may be connected to the main control valve (MCV) 300 through a hydraulic line 202. The main control valve 300 may be a device for controlling a hydraulic system of the excavator. The main control valve 300 may receive a working fluid from the main hydraulic pump 200 through the hydraulic line 202 and supply the working fluid to the actuators 10*a*, 10*b*, 10*c*, 20*a*, 20*b*, 20*c*.

The actuators may be divided into a plurality of groups and may be controlled for each group. For example, a first group of actuators may include a right traveling hydraulic motor 10*a*, a left traveling hydraulic motor 10*b* and a swing motor 10*c*. A second group of actuators may include a boom cylinder 20*a*, an arm cylinder 20*b* and a bucket cylinder 20*c*. Accordingly, each actuator may be driven by a hydraulic pressure of the working fluid discharged from the main hydraulic pump 200.

The actuators may be divided into two groups and each group may include three different actuators, however, it may not be limited thereto.

The main control valve 300 may include first spools 310*a*, 310*b* and 310*c* for controlling the right traveling hydraulic motor 10*a*, the left traveling hydraulic motor 10*b* and the swing motor 10*c* respectively. The main control valve 300 may include second spools 320*a*, 320*b* and 320*c* for controlling the boom cylinder 20*a*, the arm cylinder 20*b* and the bucket cylinder 20*c*.

In example embodiments, the main control valve 300 may be an electro-hydraulic main control valve including an electro proportional pressure reducing valve (EPPRV) which controls a pilot working fluid supplied to the spool according to an inputted electrical signal.

In particular, the main control valve 300 may include a first group of electro proportional pressure reducing valves 312 to output a secondary pressure in proportion to an external pressure command signal to the first spools 310*a*, 310*b*, 310*c* for controlling the first group of actuators 10*a*, 10*b*, 10*c* of the actuators, and a second group of electro proportional pressure reducing valves 322 to output a secondary pressure in proportion to an external pressure command signal to the second spools 320*a*, 320*b*, 320*c* for controlling the second group of actuators 20*a*, 20*b*, 20*c*.

The pilot pump 210 may discharge the pilot working fluid through a pilot line 212, and the discharged pilot working fluid may be supplied to the first group of the electro proportional pressure reducing valves 312 through a first control line 412 and may be supplied to the second group of the electro proportional pressure reducing valve 322 through a second control line 422.

The controller 500 may receive the manipulation signal in proportion to a manipulation amount of an operator from a manipulation lever 30, and may output the pressure command signal to the electro proportional pressure reducing valves 312, 322 corresponding to the manipulation signal of the construction machinery. The electro proportional pressure reducing valves 312, 322 may output a secondary pressure in proportion to the pressure command signal to the corresponding spools, to control the spools using electrical signals.

A pair of the electro proportional pressure reducing valves may be provided in both sides of the spool. The electro proportion pressure reducing valves may supply a secondary pressure in proportion to the pressure command signal to the spools respectively, and thus, the spool may move in proportion to the secondary pressure. The working fluid from the main hydraulic pump 200 may be supplied to the actuator via the spool.

In example embodiments, the control system for construction machinery may include first pressure sensors 314 for detecting the secondary pressures outputted from the first group of electro proportional pressure reducing valves 312 and second pressure sensors 324 for detecting the secondary pressures outputted from the second group of electro proportional pressure reducing valves 322.

As illustrated in FIG. 2, the main control valve 300 may include a main block (not illustrated) having the spools installed therein, a first pilot signal block (not illustrated) disposed in a first side of the main block and having electro proportional pressure reducing valves installed therein to control a pilot working fluid for moving the spools in one direction, and a second pilot signal block 302 disposed in a second side of the main block opposite to the first side and having the electro proportional pressure reducing valves 312, 322 installed therein to control the pilot working fluid for moving the spools in a reverse direction.

The first group of electro proportional pressure reducing valves 312 may be installed in a first side of the second pilot signal block 302 to be spaced apart from each other along a first direction, and the second group of electro proportional pressure reducing valves 322 may be installed in a second side of the second pilot signal block 302 opposite to the first side to be spaced apart from each other along the first direction. The first pressure sensors 314 may be installed in the first side of the second pilot signal block 302 to be spaced apart from each other along the first direction, and the second pressure sensors 324 may be installed in the second side of the second pilot signal block 302 to be spaced apart from each other along the first direction.

The first pressure sensor 314 may be installed adjacent to the first group of electro proportional pressure reducing valve 312. The first pressure sensor 314 may detect a pressure of the pilot working fluid (secondary pressure) which is controlled to be supplied to the first spool by the first group of electro proportional pressure reducing valve 312. The second pressure sensor 324 may be installed adjacent to the second group of electro proportional pressure reducing valve 322. The second pressure sensor 324 may detect a pressure of the pilot working fluid (secondary pressure) which is controlled to be supplied to the second spool by the second group of electro proportional pressure reducing valve 322.

The controller 500 may compare the secondary pressures detected by the first and second pressure sensors 314, 324 and the pressure command signals inputted to the first and second groups of electro proportional pressure reducing valves 312, 322, to determine whether or not the electro proportional pressure reducing valves fail.

The controller 500 may include a first controller 510 configured to determine whether or not the first group of electro proportional pressure reducing valves 312 fail and a second controller 520 configured to determine whether or not the second group of electro proportional pressure reducing valves 322 fail.

The first controller 510 may compare the secondary pressures detected by the first pressure sensors 314 and the pressure command signals inputted to the first group of the electro proportional pressure reducing valves 312 to determine whether or not the first group of electro proportional pressure reducing valves 312 fail. For example, if a difference value between the secondary pressure detected by the first pressure sensor and the pressure command signal exceeds a predetermined value (limited value), it may be determined by the first controller 510 that the electro proportional pressure reducing valve, which outputs the second pressure detected by the first pressure sensor, breaks down.

The second controller 520 may compare the secondary pressures detected by the second pressure sensors 324 and the pressure command signals inputted to the second group of the electro proportional pressure reducing valves 322 to determine whether or not the second group of electro proportional pressure reducing valves 322 fail. For example, if a difference value between the secondary pressure detected by the second pressure sensor and the pressure command signal exceeds a predetermined value (limited value), it may be determined by the second controller 520 that the electro proportional pressure reducing valve, which outputs the second pressure detected by the second pressure sensor, breaks down.

In example embodiments, a first control valve 410 may be installed in the first control line 412 through which the pilot working fluid is supplied to the first group of electro proportional pressure reducing valves 312, to selectively open and close the first control line 412 by an external block signal. A second control valve 420 may be installed in the second control line 422 through which the pilot working fluid is supplied to the second group of electro proportional pressure reducing valves 322, to selectively open and close the second control line 422 by an external block signal. For example, the first and second control valves may include a solenoid valve.

When it is determined that any one of the first group of electro proportional pressure reducing valves 312 fails, the first controller 510 may generate a first block signal for blocking the pilot working fluid from being supplied to the first group of electro proportional pressure reducing valves 312 and output the first block signal to the first control valve 410. Accordingly, the first control valve 410 may be closed by the first block signal to block the supply of the pilot working fluid through the first control line 412, so that all the first group of electro proportional pressure reducing valves 312 may cease to operate.

When it is determined that any one of the second group of electro proportional pressure reducing valves 322 fails, the second controller 520 may generate a second block signal for blocking the pilot working fluid from being supplied to the second group of electro proportional pressure reducing valves 322 and output the second block signal to the second control valve 420. Accordingly, the second control valve 420 may be closed by the second block signal to block the supply of the pilot working fluid through the second control line 422, so that all the second group of electro proportional pressure reducing valves 322 may cease to operate.

When it is determined that any one of the first group of electro proportional valves 312 fails, the first control valve 410 may be closed to block the pilot working fluid from being supplied to the first group of electro proportional pressure reducing valves 312. Thus, even though an operator manipulates the manipulation lever 30, the first group of actuators 10*a*, 10*b*, 10*c* may not operate based upon the manipulation of the manipulation lever 30 of the operator, while the second group of actuators 20*a*, 20*b*, 20*c* may still operate based upon the manipulation of the manipulation lever 30 of the operator.

When it is determined that any one of the second group of electro proportional valves 322 fails, the second control valve 420 may be closed to block the pilot working fluid from being supplied to the second group of electro proportional pressure reducing valves 322. Thus, even though an operator manipulates the manipulation lever 30, the second group of actuators 20*a*, 20*b*, 20*c* may not operate based upon the manipulation of the manipulation lever 30 of the operator, while the first group of actuators 10*a*, 10*b*, 10*c* may still operate based upon the manipulation of the manipulation lever 30 of the operator.

In example embodiments, a safety lever valve 400 may be installed in the pilot line 212. The pilot line 212 may be connected to the first and second control lines 412. The pilot working fluid discharged from the pilot pump 210 may be supplied to the first group of electro proportional pressure reducing valves 312 through the first control line 412 and may be supplied to the second group of electro proportional pressure reducing valves 322 through the second control valve 422. For example, the safety lever valve 400 may include a solenoid valve.

The safety lever valve 400 may be controlled to be closed based upon a manipulation of a safety lever or push of an engine emergency stop button in a cabin, to block the supply of the pilot working fluid through the pilot line 212. Thus, as the supply of the pilot working fluid to the first and second groups of electro proportional pressure reducing valves 312, 322 is blocked, even though an operator manipulates the manipulation lever 30, the first and second groups of actuators 10*a*, 10*b*, 10*c*, 20*a*, 20*b*, 20*c* may not operate based upon the manipulation of the manipulation lever 30 of the operator.

Hereinafter, a hydraulic control method for construction machinery using the hydraulic system of the construction machinery in FIG. 1 will be explained.

Figure 3:
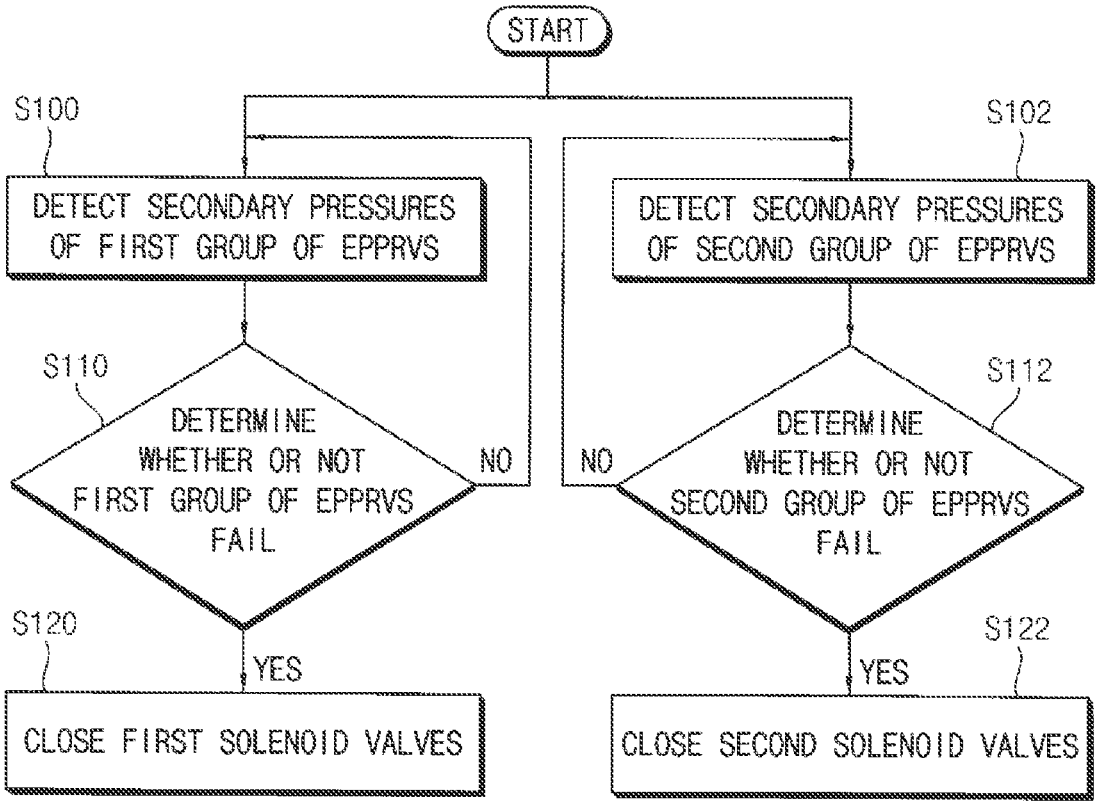
FIG. 3 is a flow chart illustrating a method of control a main control valve of construction machinery using the control system in FIG. 1.

FIG. 3 is a flow chart illustrating a method of control a main control valve of construction machinery using the control system in FIG. 1.

Referring to FIGS. 1 to 3, first, electro proportional pressure reducing valves of a main control valve 300 may be divided into a first group of electro proportional pressure reducing valves 312 and a second group of electro proportional pressure reducing valves 322, secondary pressures of the first group of electro proportional pressure reducing valves 312 may be detected (S100), and then, secondary pressures of the second group of electro proportional pressure reducing valves 322 may be detected (S110).

In example embodiments, actuators of construction machinery may be divided into at least two groups and the electro proportional pressure reducing valves of the main control valve may be grouped corresponding to the groups in order to control the corresponding group of actuators.

For example, the first group of electro proportional pressure reducing valves 312 may output a secondary pressure in proportion to an external pressure command signal to first spools 310*a*, 310*b*, 310*c* for controlling the first group of actuators. The first group of first group of actuators may include a right traveling hydraulic motor 10*a*, a left traveling hydraulic motor 10*b* and a swing motor 10*c*. The second group of electro proportional pressure reducing valves 322 may output a secondary pressure in proportion to an external pressure command signal to second spools 320*a*, 320*b*, 320*c* for controlling the second group of actuators. The second group of actuators may include a boom cylinder 20*a*, an arm cylinder 20*b* and a bucket cylinder 20*c*.

The secondary pressures outputted from the first group of electro proportional pressure reducing valves 312 may be detected by first pressure sensors 314, and secondary pressures outputted from the second group of electro proportional pressure reducing valves 322 may be detected by second pressure sensors 324.

Then, whether or not the first group of electro proportional pressure reducing valves 312 fail may be determined (S110) and whether or not the second group of electro proportional pressure reducing valves 314 fail may be determined (S112).

The secondary pressures detected by the first and second pressure sensors 314, 324 and the external pressure command signals applied to the electro proportional pressure reducing valves may be compared to determine whether or not the electro proportional pressure reducing valves fail. In particular, the secondary pressures detected by the first pressure sensors 314 and the pressure command signals applied to the first group of the electro proportional pressure reducing valves 312 to determine whether or not the first group of electro proportional pressure reducing valves 312 fail. The secondary pressures detected by the second pressure sensors 324 and the pressure command signals applied to the second group of the electro proportional pressure reducing valves 322 may be compared to determine whether or not the second group of electro proportional pressure reducing valves 322 fail.

Then, when it is determined that any one of the first group of electro proportional pressure reducing valves 312 fails, a first control valve 410 may be closed to block the pilot working fluid from being supplied to the first group of electro proportional pressure reducing valves 312 (S120), and when it is determined that any one of the second group of electro proportional pressure reducing valves 322 fails, a second control valve 420 may be closed to block the pilot working fluid from being supplied to the second group of electro proportional pressure reducing valves 322 (S122).

In example embodiments, when it is determined that any one of the first group of electro proportional pressure reducing valves 312 fails, a first controller 510 may generate a first block signal to the first control valve 410 and then the first control valve 410 may be closed to block the supply of the pilot working fluid to the first group of electro proportional pressure reducing valves 312 through a first control line 412. When it is determined that any one of the second group of electro proportional pressure reducing valves 322 fails, a second controller 520 may generate a second block signal to the second control valve 420 and then the second control valve 410 may be closed to block the supply of the pilot working fluid to the second group of electro proportional pressure reducing valves 312 through a second control line 412.

In example embodiments, when any one of electro proportional pressure reducing valves included in a particular group fails, the electro proportional pressure reducing valves included only in the particular group may cease to operate, while electro proportional pressure reducing valves included in other groups may still operate. Accordingly, the electro proportional pressure reducing valves of the particular group including the broken EPPRV may be disabled, while the electro proportional pressure reducing valves of other group electro proportional pressure reducing valves included in other groups may be maintained to be operable.

For example, when any one of electro proportional pressure reducing valves related to operation controls of a boom, an arm and a bucket fails, all the electro proportional pressure reducing valves of a particular group including the broken EPPRV may be controlled to be disabled. Thus, the boom, the arm and the bucket may not operate, but a swing motor and traveling motors may operate to get out of a danger zone and move to a serviceable zone.

As mentioned above, a malfunction related to an electro proportional pressure reducing valve (EPPRV) may be detected immediately, an operation of an actuator related to the broken EPPRV may be stopped and other actuators may be still operable, and thus, construction machine may escape from a danger zone and move to a serviceable zone.

Figure 4:
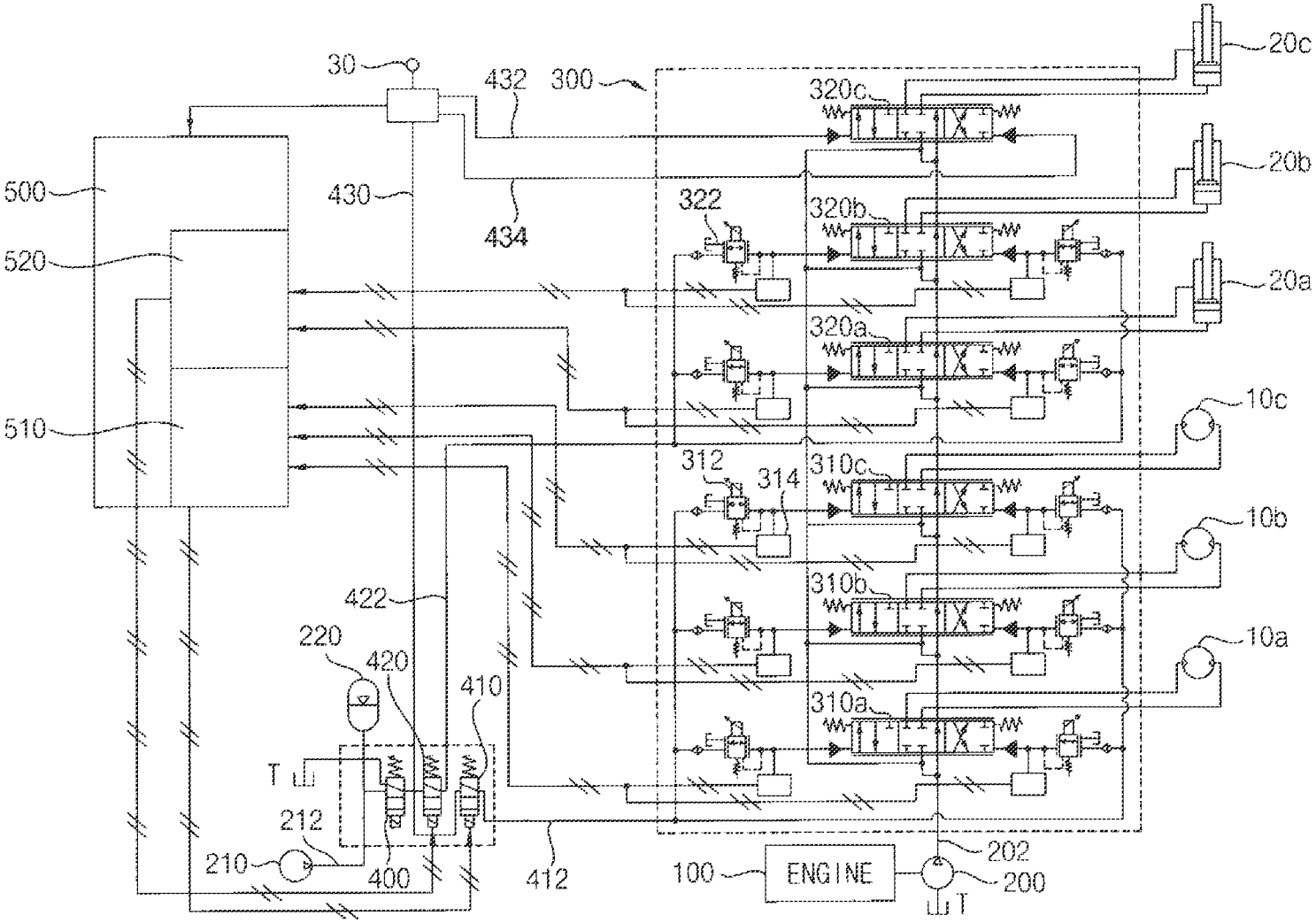
FIG. 4 is a hydraulic circuit diagram illustrating a control system for construction machinery in accordance with example embodiments.

FIG. 4 is a hydraulic circuit diagram illustrating a control system for construction machinery in accordance with example embodiments. The control system may be substantially the same as or similar to the control system described with reference to FIG. 1, except for the control system further includes a hydraulic control valve. Thus, same reference numerals will be used to refer to the same or like elements, and any further repetitive explanation concerning the above elements will be omitted.

Referring to FIG. 4, a main control valve 300 may include first spools 310*a*, 310*b* and 310*c* for controlling a first group of actuators 10*a*, 10*b*, 10*c*, second spools 320*a*, 320*b* and 320*c* for controlling a second group of actuators 20*a*, 20*b*, and at least one third spool 320*c* for controlling a third group of actuator 20*c*.

For example, the first group of actuators may include a right traveling hydraulic motor 10*a*, a left traveling hydraulic motor 10*b* and a swing motor 10*c*. The second group of actuators may include a boom cylinder 20*a* and an arm cylinder 20*b*. The third group of actuator may include a bucket cylinder 20*c*.

The first spools 310*a*, 310*b*, 310*c* may be controlled by secondary pressures which the first group of electro proportional pressure reducing valves 312 output in proportion to external pressure command signals. The second spools 320*a*, 320*b* may be controlled by secondary pressures which the second group of electro proportional pressure reducing valves 322 output in proportion to external pressure command signals. The third spool 320*c* may be controlled by a pilot pressure in proportion to a manipulation amount of a manipulation lever 30.

Accordingly, some of the actuators may be controlled by an electro-hydraulic control valves and others of the actuators may be controlled by hydraulic control valves.

In particular, as an operator manipulates the manipulation lever 30, a pilot working fluid may be discharged in proportion to the manipulation amount from a pilot pump 210 and then supplied to the third spool 320*c* through third and fourth control lines 432, 434. Accordingly, the third spool 320*c* may be displaced in proportion to the pilot pressure of the pilot working fluid, and thus, a working fluid from a main hydraulic pump 200 may be supplied to the third group of actuator 20*c* through the third spool 320*c*.

In example embodiments, when any one of electro proportional pressure reducing valves included in a particular group fails, all the electro proportional pressure reducing valves included in the particular group may be controlled to be disabled, while electro proportional pressure reducing valves included in another group may be controlled to be operable and also an actuator controlled by the hydraulic control valve may be controlled independently. Accordingly, the electro proportional pressure reducing valves of the particular group including the broken EPPRV may be disabled, while actuators of other groups may be controlled independently.

It may be illustrated that the above embodiments may be applied to the excavator, however, it may not be limited thereto. For example, example embodiments may be applied to other construction machinery such as a wheel loader, a crane, a bull dozer, etc, including a hydraulic system with an electro electro-hydraulic main control valve.

The present invention has been explained with reference to preferable embodiments, however, those skilled in the art may understand that the present invention may be modified or changed without being deviated from the concept and the scope of the present invention disclosed in the following claims.

THE DESCRIPTION OF THE REFERENCE NUMERALS

10*a*: right traveling hydraulic motor
10*b*: left traveling hydraulic motor
10*c*: swing motor
20*a*: boom cylinder
20*b*: arm cylinder
20*c*: bucket cylinder
30: manipulation lever
100: engine
200: main hydraulic pump
202: hydraulic line
210: pilot pump
212: pilot line
220: accumulator
300: main control valve
302: second pilot block 310*a*, 310*b*,
310*c*: first spool
312: first group of electro proportional pressure reducing valve
314: first pressure sensor 320*a*, 320*b*,
320*c*: second spool
322: second group of electro proportional pressure reducing valve
324: second pressure sensor
330: inlet port
332: drain port
410: first control valve
412: first control line
420: second control valve
422: second control line
500: controller
510: first controller
520: second controller

What is claimed is:

1. A control system for construction machinery, comprising:

a main control valve installed in a hydraulic line between a hydraulic pump and actuators, and including a first group of electro proportional pressure reducing valves outputting a first secondary pressure in proportion to a first pressure command signal to a first spool for controlling a first group of actuators of the actuators, and a second group of electro proportional pressure reducing valves outputting a second secondary pressure in proportion to a second pressure command signal to a second spool for controlling a second group of actuators of the actuators;

a safety lever valve installed in a pilot line through which a pilot working fluid discharged from a pilot pump is supplied and configured to selectively open and close the pilot line;

a first control valve installed in a first control line through which the pilot working fluid is supplied to the first group of electro proportional pressure reducing valves and configured to selectively open and close the first control line, the first control line being connected to the safety lever valve;

a second control valve installed in a second control line through which the pilot working fluid is supplied to the second group of electro proportional pressure reducing valves and configured to selectively open and close the second control line, the second control line being connected to the safety lever valve;

a first pressure sensor configured to detect the first secondary pressure outputted from the first group of electro proportional pressure reducing valves and a second pressure sensor configured to detect the second secondary pressure outputted from the second group of electro proportional pressure reducing valves; and a controller configured to output the first and second pressure command signals to the first and second groups of electro proportional pressure reducing valves corresponding to a manipulation signal of the construction machinery, and configured to compare the first and second secondary pressures detected by the first and second pressure sensors and the first and second pressure command signals to determine whether or not the first and second groups of electro proportional pressure reducing valves fail, wherein when it is determined that any one of the first group of electro proportional pressure reducing valves fails, the controller closes the first control valve to block the pilot working fluid from being supplied to the first group of electro proportional pressure reducing valves, and when it is determined that any one of the second group of electro proportional pressure reducing valves fails, the controller closes the second control valve to block the pilot working fluid from being supplied to the second group of electro proportional pressure reducing valves, wherein the safety lever valve is configured to be closed based upon a manipulation of a safety lever or push of an engine emergency stop button in a cabin, to block the supply of the pilot working fluid through the pilot line, and wherein the first group of actuators comprises at least one of a right traveling hydraulic motor, a left traveling hydraulic motor and a swing motor, and the second group of actuators comprises at least one of a boom cylinder, an arm cylinder and a bucket cylinder.

2. The control system for construction machinery of claim 1, wherein at least one of the first and second control valves includes a solenoid valve.

3. The control system for construction machinery of claim 1, wherein the controller comprises a first controller configured to compare the first secondary pressure detected by the first pressure sensor and the first pressure command signal inputted to the first group of the electro proportional pressure reducing valves to determine whether or not the first group of electro proportional pressure reducing valves fail; and a second controller configured to compare the second secondary pressure detected by the second pressure sensor and the second pressure command signal inputted to the second group of the electro proportional pressure reducing valves to determine whether or not the second group of electro proportional pressure reducing valves fail.

4. The control system for construction machinery of claim 3, wherein when it is determined that any one of the first group of electro proportional pressure reducing valves fails, the first controller generates a first block signal for blocking the pilot working fluid from being supplied to the first group of electro proportional pressure reducing valves, and when it is determined that any one of the second group of electro proportional pressure reducing valves fails, the second controller generates a second block signal for blocking the pilot working fluid from being supplied to the second group of electro proportional pressure reducing valves.

5. A control system for construction machinery, comprising:

a main control valve installed in a hydraulic line between a hydraulic pump and actuators, and including a first group of electro proportional pressure reducing valves outputting a first secondary pressure in proportion to a first pressure command signal to a first spool for controlling a first group of actuators of the actuators, and a second group of electro proportional pressure reducing valves outputting a second secondary pressure in proportion to a second pressure command signal to a second spool for controlling a second group of actuators of the actuators;

a safety lever valve installed in a pilot line through which a pilot working fluid discharged from a pilot pump is supplied and configured to selectively open and close the pilot line;

a first control valve installed in a first control line through which the pilot working fluid is supplied to the first group of electro proportional pressure reducing valves and configured to selectively open and close the first control line, the first control line being connected to the safety lever valve;

a second control valve installed in a second control line through which the pilot working fluid is supplied to the second group of electro proportional pressure reducing valves and configured to selectively open and close the second control line, the second control line being connected to the safety lever valve;

a first pressure sensor configured to detect the first secondary pressure outputted from the first group of electro proportional pressure reducing valves and a second pressure sensor configured to detect the second secondary pressure outputted from the second group of electro proportional pressure reducing valves; and a controller configured to output the first and second pressure command signals to the first and second groups of electro proportional pressure reducing valves corresponding to a manipulation signal of the construction machinery, and configured to compare the first and second secondary pressures detected by the first and second pressure sensors and the first and second pressure command signals to determine whether or not the first and second groups of electro proportional pressure reducing valves fail, wherein when it is determined that any one of the first group of electro proportional pressure reducing valves fails, the controller closes the first control valve to block the pilot working fluid from being supplied to the first group of electro proportional pressure reducing valves, and when it is determined that any one of the second group of electro proportional pressure reducing valves fails, the controller closes the second control valve to block the pilot working fluid from being supplied to the second group of electro proportional pressure reducing valves, wherein the safety lever valve is configured to be closed based upon a manipulation of a safety lever or push of an engine emergency stop button in a cabin, to block the supply of the pilot working fluid through the pilot line, and wherein the main control valve further comprises a hydraulic control valve having a third spool for controlling a third group of actuators of the actuators, the third spool being controlled by a pilot pressure in proportion to a manipulation amount of a manipulation lever.

* * * * *